United States Patent [19]

Pringle

[11] 4,080,021

[45] Mar. 21, 1978

[54] REFRIGERATOR LINER ASSEMBLY

[75] Inventor: William L. Pringle, Grosse Pointe Shores, Mich.

[73] Assignee: United States Steel Corporation, Pittsburgh, Pa.

[21] Appl. No.: 715,887

[22] Filed: Aug. 19, 1976

[51] Int. Cl.[2] ..... F25D 11/00

[52] U.S. Cl. ..... 312/214; 312/257 R

[58] Field of Search ..... 312/214, 257 R, 257 SM, 312/236; 220/9 F

[56] References Cited

U.S. PATENT DOCUMENTS

| | | | |
|---|---|---|---|
| 1,316,061 | 9/1919 | Rotenberger | 312/257 SM |
| 1,525,203 | 2/1925 | Schmitz | 312/214 |
| 2,837,393 | 6/1958 | Sitler | 312/257 R |
| 3,095,838 | 7/1963 | Paulos et al. | 312/214 |
| 3,314,741 | 4/1967 | Litner | 312/214 |
| 3,707,243 | 12/1972 | Kitson | 312/214 |
| 3,868,152 | 2/1975 | Dixon | 312/214 |
| 3,960,631 | 6/1976 | Weiss et al. | 312/214 |
| 3,999,820 | 12/1976 | Haag | 312/214 |

FOREIGN PATENT DOCUMENTS

| | | | |
|---|---|---|---|
| 1,395,235 | 1965 | France | 312/214 |
| 2,135,724 | 1972 | Germany | 312/214 |

OTHER PUBLICATIONS

Product Engineering - Aug. 1945 by Wallace C. Mills.

*Primary Examiner*—Paul R. Gilliam
*Assistant Examiner*—Victor N. Sakran
*Attorney, Agent, or Firm*—McGlynn and Milton

[57] ABSTRACT

A coffin-like liner for the cabinet of a refrigerator to be disposed within the outer casing of the refrigerator. The liner includes a first integral sheet which defines the back and the bottom portion of the liner and a second integral sheet which defines the top and the sides of the liner. The sheets are mechanically connected together by a crimped seam along their mating edges which extend along the juncture of the sides and the bottom and along the juncture of the sides and the back and along the juncture of the top and the back. The crimped seam includes a U-shaped portion extending along the edge of the sheet defining the back and the bottom and an L-shaped flange extending along the edge of the sheet defining the top and the sides with one leg of the L-shaped disposed in the U-shaped portion. A filler material fills the space between the mating portions of the two sheets to provide a smooth continuous surface within the liner.

6 Claims, 3 Drawing Figures

REFRIGERATOR LINER ASSEMBLY

This invention relates to a refrigerator assembly and more specifically to a liner which is disposed within the cabinet or the shell of the refrigerator. Typically, such liners are supported within the shell of the refrigerator in spaced relationship thereto and supported therein by thermally nonconductive supports. Such liners are typically fabricated from stamped metal pieces which are welded or otherwise secured together. The liners typically include multiple stampings which must be secured together.

In accordance with the subject invention, there is provided a liner which is made or fabricated of a minimum of components with the components being connected together in a very efficient and inexpensive manner.

Other objects and attendant advantages of the present invention will be readily appreciated as the same becomes better understood by reference to the following detailed description when considered in connection with the accompanying drawings wherein.

Figure 1:
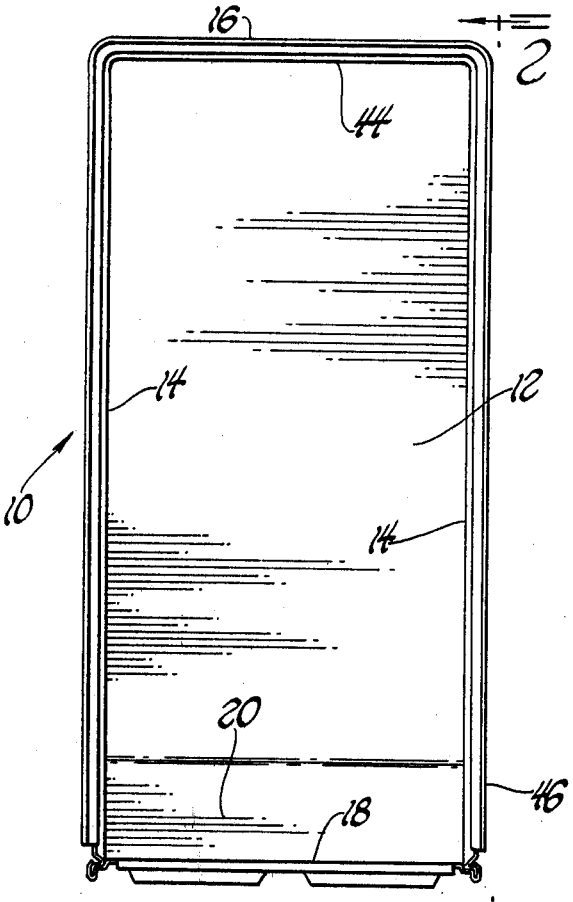
FIG. 1 is a front elevational view of a liner constructed in accordance with the subject invention.

A refrigerator liner assembly constructed in accordance with the instant invention is generally shown at 10. The refrigerator liner includes a back 12, spaced sides 14, a top 16, and a bottom 18. Either the back 12 or the bottom 18 includes an inclined interconnecting portion 20.

Figure 2:
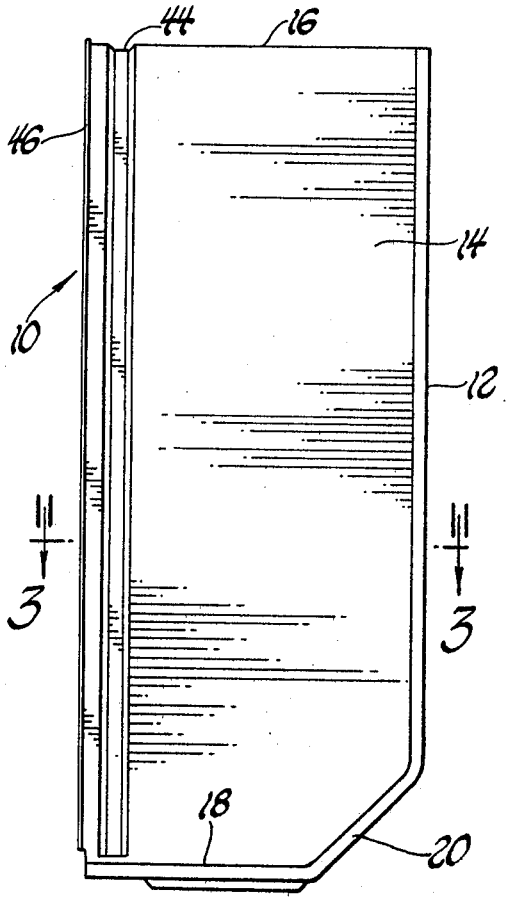
FIG. 2 is a side elevational view taken substantially along line 2—2 of FIG. 1.

The liner 10 comprises first and second respectively integral sheets connected together at their junctures. The sheets are respectively made of sheet metal stampings. The first sheet defines the back 12 and the bottom 18 whereas the second sheet defines the top 16 and the two sides 14. In other words, the integral sheet defining the back and the bottom 18 is generally L-shaped as viewed in FIG. 2 whereas the sheet defining the top 16 and the sides 14 is generally U-shaped, as viewed in FIG. 1.

Figure 3:
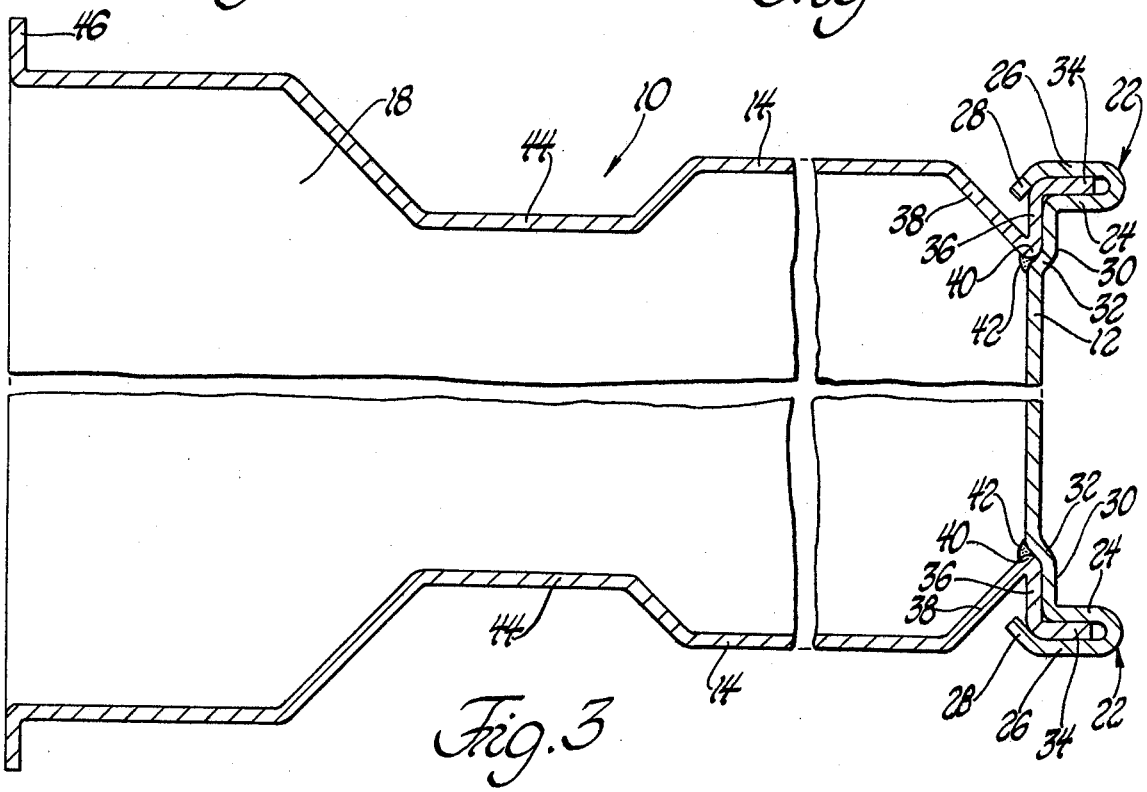
FIG. 3 is an enlarged fragmentary cross-sectional view taken substantially along line 3—3 of FIG. 2.

The two sheets are mechanically connected together by a crimped seam which is best illustrated in FIG. 3. The crimped seam includes a U-shaped portion generally indicated at 22 extending along the edge of the sheet defining the back 12 and the bottom 18. The U-shaped portion 22 includes a leg 24 integrally connected to the sheet 12 and a second leg 26 extending to a distal end which defines an inwardly extending tab 28. The leg 24 of the U-shaped portion 22 is connected to the remainder of the sheet by an offset portion 30, the offset portion 30 being immediately adjacent the U-shaped portion 22 and defining a ridge 32 at its juncture with the remainder of the sheet 12.

The other sheet which defines top 16 and the sides 14 includes an L-shaped flange extending along the edge or periphery of the sheet with a first leg 34 disposed in the U-shaped portion 22. The second leg 36 of the L-shaped portion defines a shoulder at the juncture with the first leg 34. The tab 28 at the distal end of the U-shaped portion 22 extends inwardly and about the shoulder between the legs 34 and 36 of the L-shape for retaining the leg 34 in the U-shaped portion 22.

An inwardly inclined connecting portion 38 integrally interconnects the leg 36 of the L-shaped portion and the remainder of the sheet and defines a corner 40 with the second leg 36 of the L-shaped portion.

The second leg 36 of the L-shaped portion is disposed in the offset portion 30 of the other sheet and the ridge 32 or extremity of the offset portion 30 snugly engages the corner 40 making a tight fit therebetween. A filler means or material 42 fills the space at the engagement of the corner 40 with the ridge 32 for defining a smooth surface between the two sheets. The filler material may comprise an epoxy, a paint, or a plastic organic-polymeric material. By filling this space the liner is sealed and it is easy to clean as there are no cracks for collecting dirt.

The front portion of the liner includes a groove 44 extending about the periphery thereof and also a flange 46 both of which are utilized for supporting the liner within the refrigerator cabinet, but which are not necessary in all liners constructed in accordance with the subject invention.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the present invention in which an exclusive property or privilege is claimed are defined as follows:

1. A refrigerator liner assembly generally including a back with spaced sides and a top and a bottom extending from the back to define an access opening, said assembly comprising; first and second respectively integral sheets connected together to define said back, sides, top and bottom said first sheet defining said back and said bottom, and said second sheet defining said top and said sides, said first and second sheets being mechanically connected together by a crimped seam, said crimped seam including a U-shaped portion extending along the edge of one of said sheets with one of the legs thereof integrally connected to the sheet and the other leg extending to a distal end, said crimped seam further including an L-shaped flange extending along the edge of the other sheet with a first leg of the L-shape disposed in said U-shaped portion, the second leg of the L-shape defining a shoulder at the juncture thereof with the first leg, and a tab extending from said distal end of said U-shaped portion and extending inwardly about said shoulder for retaining said second leg of said L-shape in said U-shaped portion.

2. An assembly as set forth in claim 1 including a connecting portion integrally interconnecting said second leg of said L-shaped portion and said sheet and defining a corner with said second leg of said L-shaped portion.

3. An assembly as set forth in claim 2 including an offset portion adjacent said U-shaped portion, said second leg of said L-shaped portion being disposed in said offset portion.

4. An assembly as set forth in claim 3 wherein the extremity of said offset portion snugly engages said corner.

5. An assembly as set forth in claim 4 including filler means for filling the space at the engagement of said corner with said extremity of said offset portion for defining a smooth surface therebetween.

6. An assembly as set forth in claim 5 wherein said filler means comprises a plastic material.

* * * * *